United States Patent [19]

Hamaker et al.

[11] 4,174,171

[45] Nov. 13, 1979

[54] BELT TRACKING SYSTEM

[75] Inventors: Ralph A. Hamaker, Penfield; Kenneth J. Buck, Ontario, both of N.Y.

[73] Assignee: Xerox Corporation, Stamford, Conn.

[21] Appl. No.: 927,191

[22] Filed: Jul. 24, 1978

[51] Int. Cl.[2] ..... G03G 15/00

[52] U.S. Cl. ..... 355/3 BE; 198/806; 226/23

[58] Field of Search ..... 355/3 BE, 3 R, 16; 198/806, 807; 74/242; 226/23

[56] References Cited

U.S. PATENT DOCUMENTS

| | | | |
|---|---|---|---|
| 3,715,027 | 2/1973 | Fujimoto | 198/806 |
| 3,818,391 | 6/1974 | Jordon et al. | 355/3 BE |
| 4,061,222 | 12/1977 | Rushing | 226/23 X |

OTHER PUBLICATIONS

*Research Disclosure,* "Web Tracking Apparatus", Morse et al., pp. 29–30, May 1976.

*Primary Examiner*—R. L. Moses

*Attorney, Agent, or Firm*—H. Fleischer; C. A. Green; J. J. Ralabate

[57] ABSTRACT

An apparatus in which the lateral alignment of a belt arranged to move in a pre-determined path is controlled. A support mounted resiliently constrains lateral movement of the belt causing the belt to apply a moment to a pivotably mounted steering post. As a result of this moment, the steering post pivots in a direction to restore the belt to the pre-determined path.

12 Claims, 4 Drawing Figures

BELT TRACKING SYSTEM

BACKGROUND OF THE INVENTION

This invention relates generally to an electrophotographic printing machine, and more particularly concerns an improved apparatus for controlling the lateral alignment of a moving photoconductive belt.

In an electrophotographic printing machine, a photoconductive belt is charged to a substantially uniform potential so as to sensitize the surface thereof. The charged portion of the photoconductive belt is exposed to a light image of an original document being reproduced. Exposure of the charged photoconductive belt selectively discharges the charge thereon in the irradiated areas. This records an electrostatic latent image on the photoconductive belt corresponding to the informational areas contained within the original document being reproduced. After the electrostatic latent image is recorded on the photoconductive belt, the latent image is developed by bringing a developer mix into contact therewith. Generally, the developer mix comprises toner particles adhering triboelectrically to carrier granules. The toner particles are attracted from the carrier granules to the latent image forming a toner powder image on the photoconductive belt. The toner powder image is then transferred from the photoconductive surface to a copy sheet. Finally, the copy sheet is heated to permanently affix the toner particles thereto in image configuration. This general approach was originally disclosed by Carlson in U.S. Pat. No. 2,297,691, and has been further amplified and described by many related patents in the art.

It is evident that the lateral alignment of the photoconductive belt is critical and must be controlled within prescribed tolerances. This is due to the fact that the photoconductive belt passes through many processing stations during the printing operation. As the belt passes through each of these processing stations, the location of the latent image must be precisely defined in order to optimize each operation being performed thereon. If the position of the latent image deviates from processing station to processing station, copy quality will be significantly degradated. Thus, lateral movement of the photoconductive belt must be minimized so that the belt moves in a pre-determined path.

Ideally, if the photoconductive belt was perfectly constructed and entrained about perfectly cylindrical rollers mounted and secured in an exactly parallel relationship with one another, the velocity vector of the belt would be substantially normal to the longitudinal axis of the roller and there would be no lateral walking of the belt. However, in actual practice, this is not feasible. Frequently, the velocity vector of the belt approaches the longitudinal axis or axis of rotation of the roller at an angle. This produces lateral movement of the belt relative to the roller. Alternatively, the axis of rotation of the roller may be tilted relative to the velocity vector of the belt. Under these circumstances, the belt will also move laterally. Thus, the photoconductive belt must be tracked or controlled to regulate its lateral position. Existing methods of controlling the lateral movement of the photoconductive belt comprise various forms of crowned rollers, flanged rollers, and electrical servo systems. However, systems of this type may produce high local stresses resulting in damage to the highly sensitive photoconductive belt. Steering rollers employing servo systems to maintain control generally apply less stress on the belt. However, systems of this type are costly.

Accordingly, it is a primary object of the present invention to improve the system controlling the lateral movement of the photoconductive belt employed in an electrophotographic printing machine.

PRIOR ART STATEMENT

Various types of devices have hereinbefore been developed to control the lateral alignment of a moving photoconductive belt. The following prior art appears to be relevant:

Wright et al.: U.S. Pat. No. 3,435,693; Apr. 1, 1969

Rushing: U.S. Pat. No. 4,061,222; Dec. 6, 1977

Morse et al.: Research Disclosure, 14510, pg. 29, 5/76

The pertinent portions of the foregoing prior art may be briefly summarized as follows.

Wright et al. discloses a belt entrained about rollers 4, 6, and 8. One end of the rollers are journaled in frame 40 which is pivotable. A sensing member 70 is forced to the right by the belt when it moves laterally. Sensing member 70 is connected by a linkage to frame 40. If the belt is forced against sensing member 70, the linkage rotates the frame to a position where the belt will track away from the sensing member until equilibrium is achieved.

Rushing describes a belt 12 positioned about steering roller 14, idler roller 15, and drive roller 16. The steering roller 14 is mounted rotatably on yoke 64. Yoke 64 is mounted pivotably about shaft 65. Sensor 54 detects the lateral movement of belt 12. The output signal from sensor 54 is processed by control logic which develops a signal driving gear motor 56. Gear motor 56 tilts yoke 64 causing steering roller 14 to force belt 12 into alignment.

Morse et al. discloses a passive web tracking system. Web W is supported in a closed loop path by supports 20, 30, and 40. Support 20 includes a roller 24. Roller 24 is pivotable to align its axis of rotation 23 to the normal direction of travel of web W. Flanges 26, which are fixed, engage the side edges of web W preventing lateral movement thereof.

It is believed that the scope of the present invention, as defined by the appended claims, is patentably distinguishable over the foregoing prior art taken either singly or in combination with one another.

SUMMARY OF THE INVENTION

Briefly stated, and in accordance with the present invention, there is provided an apparatus for controlling the lateral alignment of a belt arranged to move in a predetermined path.

Pursuant to the features of the invention, the apparatus includes a steering post arranged to provide support for the belt. The steering post is mounted for pivotable movement about an axis substantially normal to the longitudinal axis thereof. Means are provided for supporting resiliently the belt. The supporting means opposes the lateral movement of the belt from the predetermined path. This causes the belt to apply a moment on the steering post. The steering post pivots in a direction to restore the belt to the pre-determined path. Means move the belt substantially along the pre-determined path.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
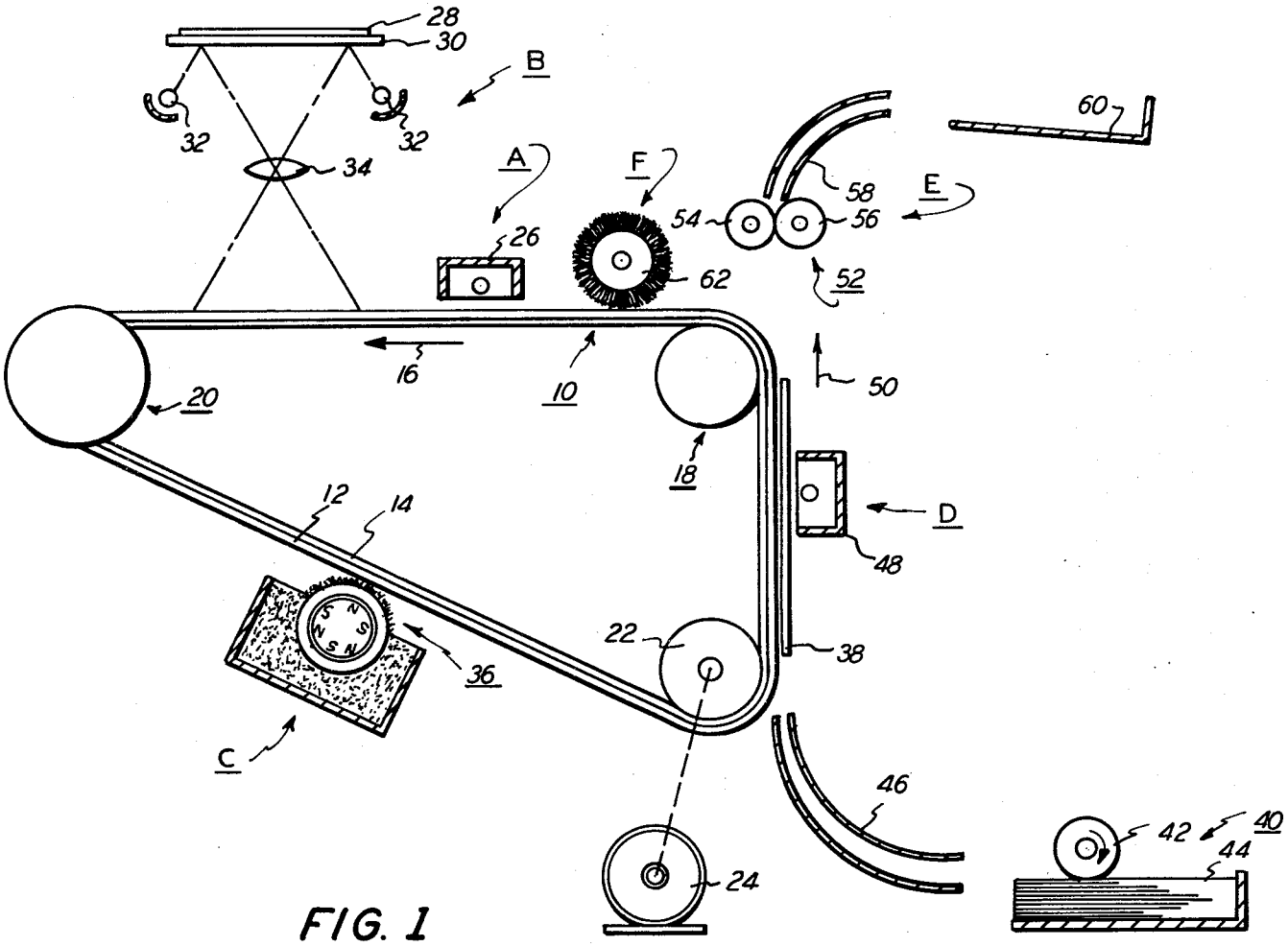
FIG. 1 is a schematic elevational view depicting an electrophotographic printing machine incorporating the features of the present invention therein.

For a general understanding of the illustrative electrophotographic printing machine incorporating the features of the present invention therein, reference is had to the drawings. In the drawings, like reference numerals have been used throughout to designate identical elements. FIG. 1 schematically depicts the various components of an electrophotographic printing machine employing the belt support and steering mechanism of the present invention therein. Although the belt steering and support mechanism is particularly well adapted for use in an electrophotographic printing machine, it will become evident from the following discussion that it is equally well suited for use in a wide variety of devices and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

Figure 2:
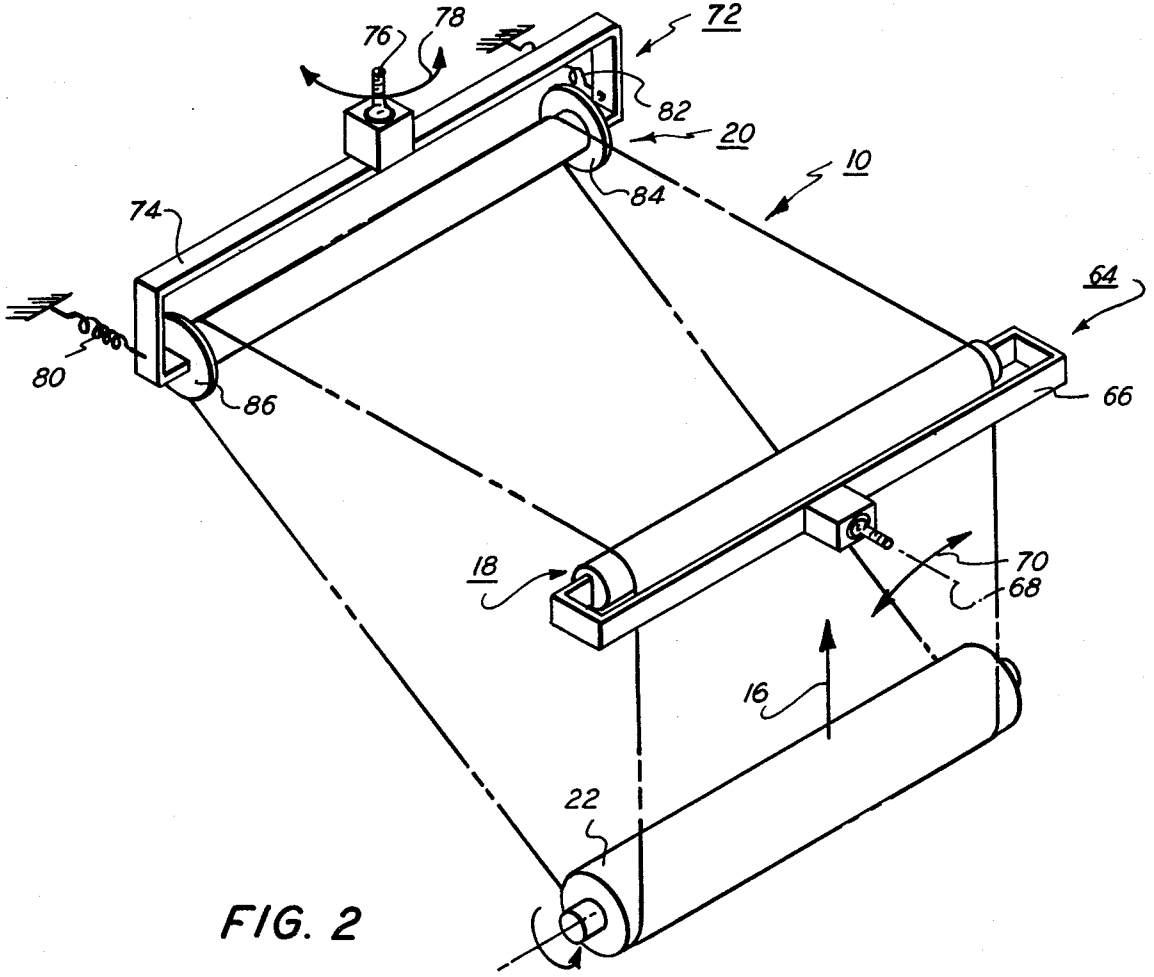
FIG. 2 is a schematic perspective view showing the belt module used in the FIG. 1 printing machine.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained about steering post 18, tension post 20, and drive roller 22. Tension post 20 is mounted resiliently on a pair of springs and arranged to pivot about an axis substantially normal to the longitudinal axis thereof. The pivot axis is substantially perpendicular to the plane defined by the approaching belt 10. Belt end guides or flanges are positioned on opposed sides thereof and define a passageway through which belt 10 passes. Steering post 18 is mounted pivotably and has a moment applied thereon by belt 10 to effect tilting thereof in a direction to reduce the approach angle of belt 10 to drive roller 22, i.e. the belt velocity vector relative to the normal to the drive roller axis of rotation. This restores belt 10 to the predetermined path of movement minimizing lateral deflection. Post 18 is adapted to pivot about an axis substantially normal to the longitudinal axis thereof. The pivot axis is substantially perpendicular to the plane defined by the approaching belt 10. Drive roller 22 is in engagement with belt 10 and advances belt 10 in the direction of arrow 16. Roller 22 is rotated by motor 24 coupled thereto by suitable means, such as a belt. A blower system is connected to steering post 18 and tension post 20. Both steering post 18 and tension post 20 have small holes in the circumferential surface thereof coupled to an interior chamber. The blower system furnishes pressurized fluid, i.e. a compressible gas such as air, into the interior chamber. The fluid egresses from the interior chamber through the apertures to form a fluid film between belt 10 and the respective post, i.e. steering post 18 and tension post 20. In this manner, the fluid film at least partially supports the belt as it passes over the respective post diminishing friction therebetween. A common blower system is employed for both steering post 18 and tension post 20. The details of the support and steering system are shown in FIG. 2 with the steering and tension post, being shown in greater detail in FIGS. 3 and 4, respectively.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential. A suitable corona generating device is described in U.S. Pat. No. 2,836,725, issued to Vyverberg in 1958.

Next, the charged portion of photoconductive surface 12 is advanced through exposure station B. At exposure station B, an original document 28 is positioned face down upon transparent platen 30. Lamps 32 flash light rays onto the original document. The light rays reflected from the original document are transmitted through lens 34 forming a light image thereof. This light image is projected onto the charged portion of photoconductive surface 12. The charged photoconductive surface is selectively discharged by the light image of the original document. This records an electrostatic latent image on photoconductive surface 12 which corresponds to the informational areas contained within original document 28.

Thereafter, belt 10 advances the electrostatic latent image recorded on photoconductive surface 12 to development station C. At development station C, a magnetic brush developer roller 36 advances the developer mix into contact with the electrostatic latent image recorded on photoconductive surface 12 of belt 10. The developer mix comprises carrier granules having toner particles adhering triboelectrically thereto. The magnetic brush developer roller forms a chain-like array of developer mix extending in an outwardly direction therefrom. The developer mix contacts the electrostatic latent image recorded on photoconductive surface 12. The latent image attracts the toner particles from the carrier granules forming a toner powder image on photoconductive surface 12 of belt 10.

The toner powder image recorded on photoconductive surface 12 of belt 10 is then transported to transfer station D. At transfer station D, a sheet of support material 38 is positioned in contact with the toner powder image deposited on photoconductive surface 12. The sheet of support material is advanced to the transfer station by a sheet feeding apparatus 40. Preferably, a sheet feeding apparatus 40 includes a feed roll 42 contacting the uppermost sheet of the stack 44 of sheets of support material. Feed roll 42 rotates so as to advance the uppermost sheet from stack 44 into chute 46. Chute 46 directs the advancing sheet of support material into contact with the photoconductive surface 12 of belt 10 in a timed sequence so that the powder image developed thereon contacts the advancing sheet of support material at transfer station D. Transfer station D includes a corona generating device 48 which applies a spray of ions to the backside of sheet 38. This attracts the toner powder image from photoconductive surface 12 to sheet 38. After transfer, the sheet continues to move in the direction of arrow 50 and is separated from belt 10 by a detack corona generating device (not shown) neutralizing the charge thereon causing sheet 38 to adhere to belt 10. A conveyor system (not shown) advances the sheet from belt 10 to fusing station E.

Fusing station E includes a fuser assembly, indicated generally by the reference numeral 52, which permanently affixes the transferred toner powder image to sheet 38. Preferably, fuser assembly 52 includes a heated fuser roller 54 and a backup roller 56. Sheet 38, passes between fuser roller 54 and backup roller 56 with the toner powder image contacting fuser roller 54. In this manner, the toner powder image is permanently affixed to sheet 38. After fusing, chute 58 guides the advancing sheet 38 to catch tray 60 for removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a rotatably mounted fiberous brush 62 in contact with photoconductive surface 12 of belt 10. The particles are cleaned from photoconductive surface 12 by the rotation of brush 62 in contact therewith. Subsequent to cleaning, a discharge lamp (not shown) floods photoconductive surface 12 with light to dissipate any residual electrostatic charge remaining thereon prior to the charging thereof for next successive imaging cycle.

It is believed that the foregoing description is sufficient for purposes of the present application to illustrate the general operation of an electrophotographic printing machine.

Referring now to the specific subject matter of the present invention, FIG. 2 depicts the structure for maintaining belt 10 substantially in lateral alignment during the movement thereof in the direction of arrow 16.

Referring now to FIG. 2, steering post 18 is supported pivotably in yoke 64. Yoke 64 includes a U-shaped member 66 having post 18 mounted fixedly therein. A rod 68 extends from the center of U-shaped member 66 and is mounted rotatably in a fixed frame. Preferably, rod 68 is supported in a suitable bearing minimizing friction during the pivoting thereof. The longitudinal axis of rod 68 is substantially normal to the longitudinal axis of post 18. In this manner, post 18 pivots in the direction of arrow 70 about the axis of rotation of rod 68.

Tension post 20 is supported pivotably in yoke 72. Yoke 72 includes a U-shaped member 74 having post 20 mounted fixedly therein. A rod 76 extends from the center of U-shaped member 74 and is mounted rotatably in a fixed frame. Preferably rod 76 is supported in a suitable bearing minimizing friction during the pivoting thereof. The longitudinal axis of rod 76 is substantially normal to the longitudinal axis of post 20. In this manner, post 20 pivots in the direction of arrow 78 about the axis of rotation of rod 76. Springs 80 and 82 are secured to opposed end portions of U-shaped member 74. Springs 80 and 82 resiliently urge post 20 toward belt 10. In this manner, post 20 maintains belt 10 under suitable uniform tension. End guides 84 and 86, are circular flanges disposed on opposed ends of post 20 being integral therewith. In this manner, end guides 84 and 86 move or pivot with post 20. The space between end guides 84 and 86 is sufficient to permit belt 10 to pass therethrough, i.e. guides 84 and 86 define a passageway through which belt 10 passes.

In operation, if belt 10 moves laterally, end guides 84 and 86 oppose this movement. Thus, end guides 84 and 86 serve as a point about which belt 10 pivots during tracking. As belt 10 pivots, non-uniform strains are induced in the belt. This causes the belt to apply a torque on steering post 18. The torque applied on steering post 18 pivots it in a direction which reduces the approach angle of belt 10 relative to drive rollers 22. This reduces the lateral component of the velocity vector of belt 10 which as a consequence, reduces the tracking rate. Thus, the present belt tracking system controls lateral deviation of the belt from a pre-determined path by employing edge guides which act to constrain the lateral movement of belt 10. This causes belt 10 to pivot about the tension post inducing strains therein. These strains are transmitted to the steering post as a torque. This torque causes the steering post to pivot in a direction such that the angle of approach of belt 10 relative to drive roller 22 is reduced, thereby returning belt 10 to the predetermined path of movement. Inasmuch as belt 10 is at least partially supported, by a fluid film, the system response time is relatively rapid and the required control forces are relatively minimal. It should be noted that if system skew is such that the belt always tracks in one direction, then only one end guide or flange is required.

Figure 3:
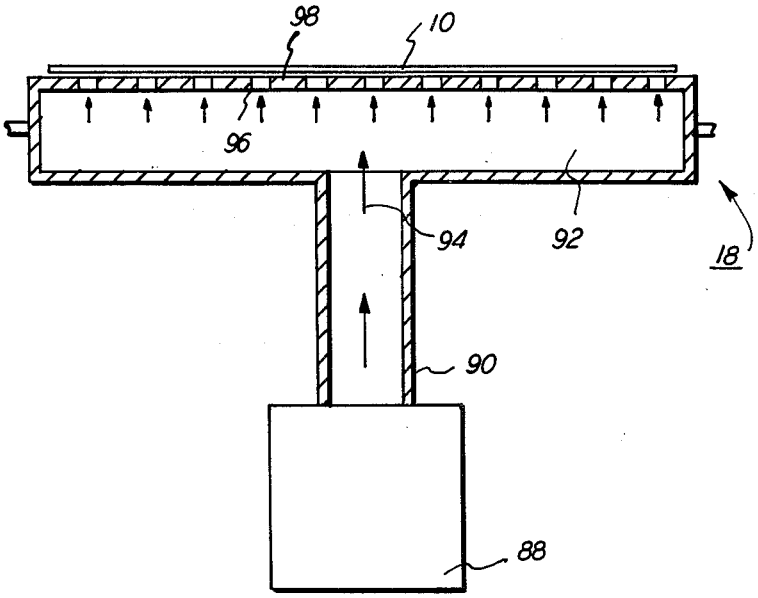
FIG. 3 is a sectional elevational view of the steering post used in the FIG. 2 belt module.

Referring now to FIG. 3, there is shown the detailed structure of steering post 18 and the pneumatic system associated therewith for supporting belt 10 by a fluid film. As shown in FIG. 3, blower 88 is coupled via conduit 90 to interior chamber 92 of post 18. Compressed air is furnished from blower 88 and it moves in the direction of arrow 94 into chamber 92 of post 18. Post 18 includes a plurality of apertures 96 is the circumferential surface thereof substantially along the line of tangency of belt 10 with post 18. Compressed air flows through apertures 96 into gap 98 between belt 10 and the circumferential surface of post 18. The compressed air is under pressure and supplies the supporting force for belt 10 so as to at least partially space belt 10 from the circumferential surface of post 18 minimizing friction therebetween as belt 10 moves in the direction of arrow 16. Air moves in gap 98 circumferentially, i.e. in the direction of movement of belt 10 to escape to the atmosphere. It is, thus, seen that the pneumatic system generates a pressurized fluid which at least partially supports belt 10 as it passes over post 18 so as to minimize friction therebetween.

Figure 4:
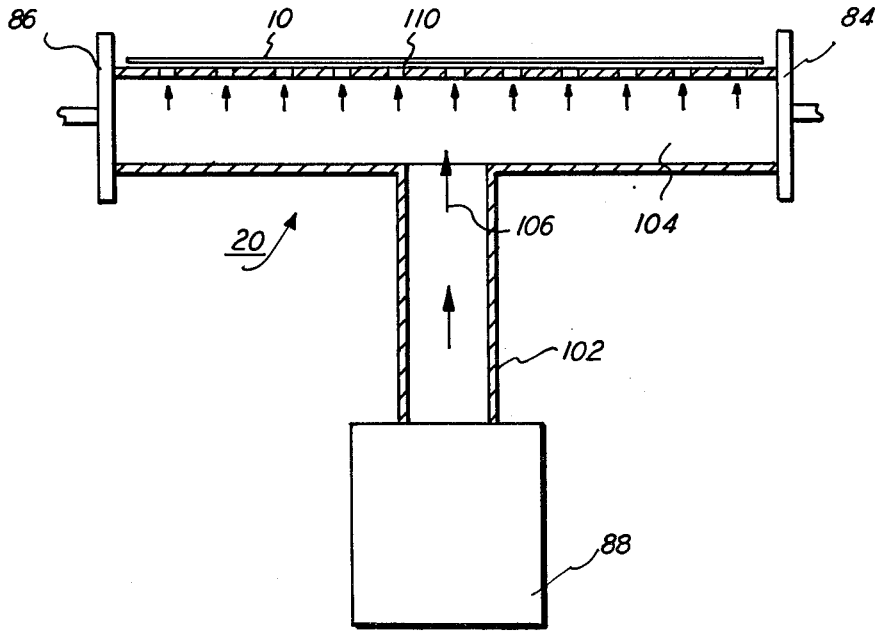
FIG. 4, is a sectional elevational view of the resilient support used in the FIG. 2 belt module.

Turning now to FIG. 4, there is shown the detailed structure of tension post 20. As shown thereat, end guides 84 and 86 are disposed at opposed marginal end regions of post 20. Blower 88 is coupled via conduit 102 to interior chamber 104 of post 20. Compressed air is furnished from blower 88 and it moves in the direction of arrow 106 into chamber 104 of post 20. Post 20 includes a plurality of apertures 108 in the circumferential surface thereof substantially along the line of tangency of belt 10 with post 20. Compressed air flows through aperture 108 into gap 110 between belt 10 and the circumferential surface of post 20. The compressed air is under pressure and supplies a supporting force for belt 10 so as to at least partially space belt 10 from the circumferential surface of post 20 minimizing friction therebetween as belt 10 moves in the direction of arrow 16. Air moves in gap 110 circumferentially to escape to the atmosphere. Hence, the pneumatic system generates pressurized fluid to at least partially support the photoconductive belt spaced from post 20 as well as post 18. In this way, the friction between the belt and the respective post is minimized as the belt moves thereabout.

In recapitulation, it is evident that the apparatus of the present invention controls the lateral movement of the belt and provides a fluid support therefor. This significantly reduces friction between the respective supports and belt minimizing the required edge forces during tracking corrections. In addition, this system automatically constrains the lateral deviations of the belt from the predetermined path of movement. This insures that the belt is located appropriately relative to each processing station so as to optimize copy quality. Belt steering is achieved by a pair of spaced edge guides which constrain the lateral movement of the belt causing the belt to pivot. As the belt pivots, it induces strains therein which apply a moment to the steering post. This pivots the steering post in a direction to reduce the belt's approach angle relative to the drive roller, thereby restoring the belt to the pre-determined path of movement eliminating any lateral deviations therefrom.

It is, therefore, evident that there has been provided in accordance with the present invention, an apparatus for supporting and controlling the lateral movement of a photoconductive belt such that the belt moves in a pre-determined path. This apparatus fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for controlling the lateral alignment of a belt arranged to move in a pre-determined path, including:

a steering post arranged to provide support for the belt and being mounted for pivotable movement about an axis substantially normal to the longitudinal axis thereof;

means for supporting resiliently the belt, said supporting means opposing the movement of the belt laterally from the pre-determined path and causing the belt to apply a moment on said steering post pivoting said steering post in the direction to restore the belt to the pre-determined path;

means for moving the belt in the pre-determined path; and means for supplying a pressurized fluid between at least a portion of said steering post and the belt to form a fluid film supporting the belt and reducing friction between the belt and said steering post.

2. An apparatus as recited in claim 1, wherein said steering post defines an interior chamber in communication with said supplying means and having a plurality of apertures in the periphery thereof through which pressurized fluid flows to form a fluid film between said steering post and the portion of the belt passing thereover.

3. An apparatus as recited in claim 1 or 2, wherein said supporting means includes a pivotably mounted post defining an interior chamber in communication with said supplying means and having a plurality of apertures in the periphery thereof through which the pressurized fluid flows to form the fluid film between said post and the portion of the belt passing thereover.

4. An apparatus as recited in claim 3, wherein said supporting means includes at least one spring urging said post to maintain the belt passing thereover under tension.

5. An apparatus as recited in claim 4, wherein said supporting means includes a pair of opposed, spaced end guides, one of said pair of end guides being secured to one marginal end of said post and the other of said pair of end guides being secured to the other marginal end of said post, said pair of end guides extending in a direction substantially normal to the longitudinal axis of said post and being spaced from one another a distance sufficient to define a passageway through which the belt moves.

6. An apparatus as recited in claim 5, wherein said moving means includes:

a drive roller in engagement with the belt; and means for rotating said drive roller to move the belt in the pre-determined path.

7. An electrophotographic printing machine of the type having an endless photoconductive belt moving in a pre-determined path through a plurality of processing stations disposed thereabout, wherein the improvement includes:

a steering post arranged to provide support for the belt and being mounted for pivotable movement about an axis substantially normal to the longitudinal axis thereof;

means for supporting resiliently the belt, said supporting means opposing the movement of the belt laterally from the pre-determined path and causing the belt to apply a moment on said steering post pivoting said steering post in a direction to restore the belt to the pre-determined path;

means for moving the belt in the pre-determined path; and means for supplying a pressurized fluid between at least a portion of said steering post and the belt to form a fluid film supporting the belt and reducing friction between the belt and said steering post.

8. A printing machine machine as recited in claim 7, wherein said steering post defines an interior chamber in communication with said supplying means and having a plurality of apertures in the periphery thereof through which pressurized fluid flows to form the fluid film between said steering post and the portion of the belt passing thereover.

9. A printing machine as recited in claim 7 or 8, wherein said supporting means includes a pivotably mounted post defining an interior chamber in communication with said supplying means and having a plurality of apertures in the periphery thereof through which the pressurized fluid flows to form a fluid film between said post and the portion of the belt passing thereover.

10. A printing machine as recited in claim 9, wherein said supporting means includes at least one spring urging said post to maintain the belt passing thereover under tension.

11. A printing machine as recited in claim 10, wherein said supporting means includes a pair of opposed, spaced end guides, one of said pair of end guides being secured to one marginal end of said post and the other of said pair of end guides being secured to the other marginal end of said post, said pair of end guides extending in a direction substantially normal to the longitudinal axis of said post and being spaced from one another a distance sufficient to define a passageway through which the belt moves.

12. A printing machine as recited in claim 11, wherein said moving means includes:

a drive roller in engagement with the belt; and means for rotating said drive roller to move the belt in the pre-determined path.

* * * * *